United States Patent [19]

Gondeck

[11] 4,061,448

[45] Dec. 6, 1977

[54] DRIVE FOR THE IGNITION DISTRIBUTOR OF AN INTERNAL COMBUSTION ENGINE

[75] Inventor: Hans-Ullrich Gondeck, Cologne, Germany

[73] Assignee: Ford Motor Company, Dearborn, Mich.

[21] Appl. No.: 739,893

[22] Filed: Nov. 8, 1976

[30] Foreign Application Priority Data

Nov. 11, 1975 Germany ..... 2550501

[51] Int. Cl.[2] ..... F01C 1/10; F03C 3/00

[52] U.S. Cl. ..... 418/170; 418/181; 74/804; 123/146.5 A; 74/15.2; 74/15.63

[58] Field of Search ..... 74/804, 805, 15.63, 74/15.2; 200/179; 123/146.5 A, 146.5 D, 146 R; 418/169, 170, 171, 181

[56] References Cited

U.S. PATENT DOCUMENTS

| | | | |
|---|---|---|---|
| 3,367,239 | 2/1968 | Takagi | 418/54 |
| 3,662,726 | 5/1972 | Haskew et al. | 123/146.5 A |

*Primary Examiner*—Benjamin W. Wyche
*Assistant Examiner*—Frank H. McKenzie, Jr.
*Attorney, Agent, or Firm*—Robert W. Brown; Keith L. Zerschling

[57] ABSTRACT

An improved drive for the ignition distributor of an internal combustion engine of the type having a lubrication pump driven by its crankshaft. The pump has an internal gear driven by and coaxial with the crankshaft. An external gear has internal teeth and is driven, in planetary gear fashion, by the internal gear. A distributor shaft is rotatably mounted in the pump housing and has a helical tooth pinion gear that meshes with helical teeth on the external periphery of the external pump gear. Thus, the driven external gear drives the pinion gear and the distributor shaft. Preferably, the transmission ratio is 1 to 1.25 between the internal and external gears and 1 to 1.6 between the external and pinion gears, providing an overall ratio of 1 to 2 between crankshaft and distributor shaft.

4 Claims, 2 Drawing Figures

DRIVE FOR THE IGNITION DISTRIBUTOR OF AN INTERNAL COMBUSTION ENGINE

BACKGROUND

The present invention relates to an improved drive for the ignition distributor of an internal combustion engine, in association with a lubrication pump drive.

In conventional internal combustion engines with a camshaft arranged laterally in the cylinder block, the camshaft drives an intermediate shaft disposed substantially perpendicularly to it, through the agency of helical gearing, the bottom end of the intermediate shaft being connected to a lubrication pump and the top end to a distributor shaft.

In these known distributor drives, because of the 1:1 transmission ratio of the helical gearing, which is always required, difficulties were encountered when toothing errors occurred, and these led to increased wear and noise in the distributor drive.

In more modern internal combustion engines with a camshaft located at the top of the cylinder head, in other words over-head camshaft engines, a layshaft located laterally in the cylinder block was provided and this was driven through the camshaft drive, at the same speed as the camshaft. This layshaft also, through the agency of helical gearing, drove an intermediate shaft extending substantially perpendicularly to it, the bottom end of which was once again connected to a lubrication pump and the top end to a distributor shaft.

Here, again, because the layshaft was driven at the same speed as the camshaft, a transmission ratio 1:1 through the helical gearing was required, and again, in the event of toothing errors this tended to lead to wear and noise problems in the distributor shaft drive.

Moreover, a relatively large amount of constructional outlay was necessitated by the arrangement and the driving of the layshaft, so that even in more modern engines using an overhead camshaft, this kind of layshaft was as far as possible avoided.

This led, in a recently developed internal combustion engine with an overhead camshaft, to the separation of the lubrication pump drive and the ignition distributor drive, the lubrication pump being arranged directly on the crankshaft in accordance with German Published Patent Application DT-OS 1,576,345 and being driven thereby, and the distributor being arranged in direct extension of the camshaft and being driven directly by the latter.

The arrangement of the lubrication pump directly on the crankshaft resulted in a highly favorable situation, without any unwanted disadvantages, from the point of view of constructional outlay.

The arrangement of the distributor in direct extension of the camshaft, although highly favorable from the point of view of constructional outlay, nevertheless had the drawback that the operation of the distributor could on occasion be severely impaired due to the substantial level of torsional vibration occurring in the camshaft.

It was discovered in this context that in the conventional distributor drive arrangement, which simultaneously drove a lubrication pump, a highly desirable effect arose, namely that the lubrication pump acted as proportional vibration damper, the absence of which in the later systems caused serious problems.

SUMMARY OF THE INVENTION

The object of the invention is consequently to provide a distributor drive in association with a lubrication pump drive, the starting point being a favorable arrangement of the lubrication pump, as specified in DT-OS 1,576,345, which has benefits to offer from the point of view of constructional outlay, the transmission ratio of the helical gearing being so chosen that the known difficulties occurring in the event of toothing defects, are as far as possible avoided.

Through the choice, in accordance with the invention, of a known kind of lubrication pump arrangement, directly on the crankshaft, the distributor being driven from the external helical gear of the crankshaft, a favorable, damped drive system for the distributor is created at the expenditure of small constructional outlay. This is due to the possibility which is created for splitting the overall transmission ratio of 1 to 2 which is required, into a transmission of 1 to 1.25 from internal gear to external gear, and a transmission ratio of 1 to 1.6 from helical gearing to pinion, so that because of the odd transmission ratios (used here for the first time) in the distributor drive, the disturbing influence of toothing errors is largely avoided. This result is also due to the facility for mounting the gears which form the lubricating pump, one of these gears also carrying the helical toothing, as well as the distributor shaft which carries the pinion, in an oil pump casing so that the teeth of the gears can run with a small flank clearance something which, in association with the damping properties presented by the oil cushion in the lubricating pump, counteracts the negative effects of torsional vibrations in the crankshaft.

DETAILED DESCRIPTION

Figure 1:
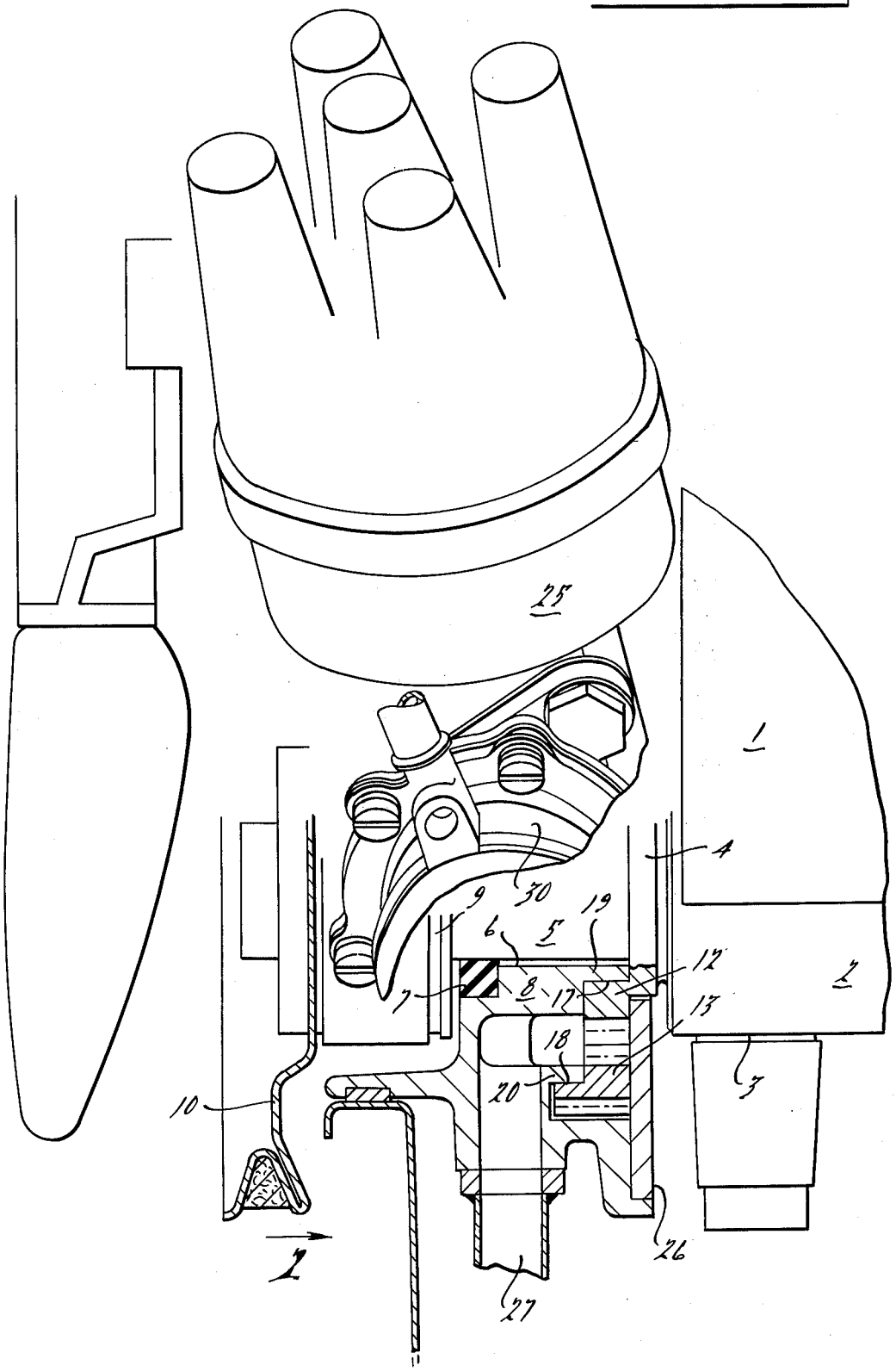
FIG. 1 is a partial side elevation of the forward end of the internal combustion engine with the lubricating pump illustrated in section and the sketched indication of the distributor location and possible that of a fuel pump.
Figure 2:
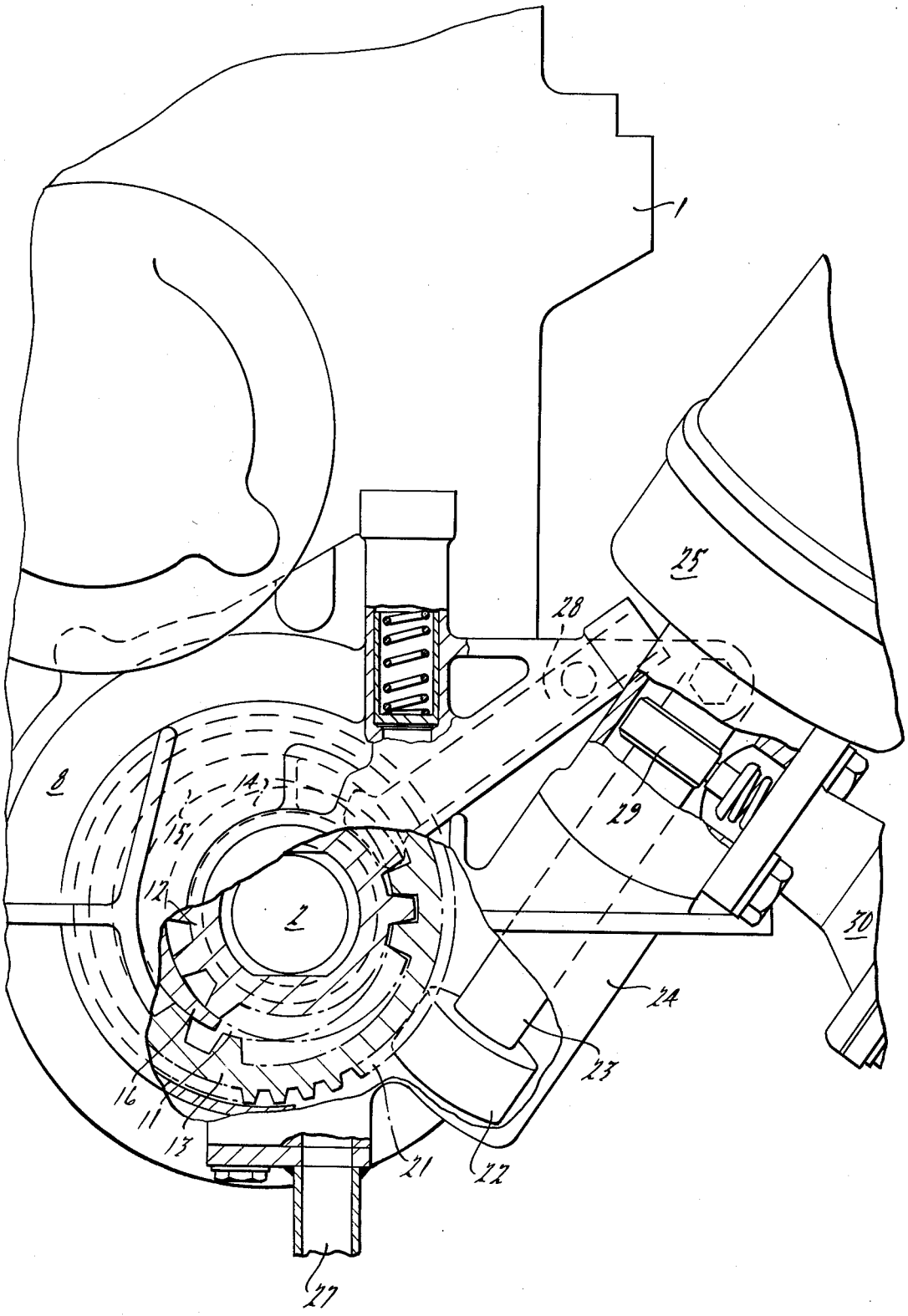
FIG. 2 illustrates a view of the forward end of the internal combustion engine taken in the direction of the arrow 2 of FIG. 1, with the distributor drive in accordance with the invention being shown partially in section.

In the figures, in a cylinder block 1 of an internal combustion engine 2 is rotatably assembled in conventional bearing arrangements 3. The front end of the crankshaft 2, here in the form of a stub 5 carrying a driver 4, extends through the bearing arrangements 3 and passes outside through a bore 6 and a seal 7 as well as through the pump casing 8 in order to carry a wheel 9 for a toothed belt driving the overhead camshaft, and a v-belt pulley 10 to drive the cooling fan and a water pump plus electrical generator.

The pump casing 8 contains an opening 11 in which gears 12 and 13, meshing with one another planet gear fashion, are arranged. The internal gear 12, having external teeth 14, is here disposed coaxially with the crankshaft 2 and is attached to the latter through the driver 4 in such a fashion that it can move axially thereon but cannot rotate relative thereto. The external gear 13, having internal teeth 15, is disposed in an eccentric relationship, the resultant crescent shaped gap in the opening 11 being filled out by a correspondingly shaped displacement wedge 16. The internal gear 12 is in driving mesh with the external gear 13.

Both the internal gear 12 and the external gear 13 are centered through internal shoulders 17 and 18 on spigots 19 and 20 in the pump casing 8 and are rotatably mounted therein.

The external gear 13 is provided at its external periphery with helical toothing 21 meshing with a pinion 22 on a distributor shaft 23 rotatably assembled in a section 24 of the pump casing 8 and driving a distributor 25.

The opening 11 in the pump casing 8, which receives the two gears 12 and 13, is closed off by an end cover 26 which at the same time axially locates the gears. The opening 11 is furthermore connected in a manner known per se with a suction line 27 and a delivery like 28 for the lubricating oil.

The overall transmission ratio of 1 to 2 is split here into a transmission ratio of 1 to 1.25 from internal gear 12 to external gear 13, and a transmission ratio of 1 to 1.6 from helical toothing 21 to pinion 22. This achieves the advantage that the adverse effects of toothing errors are very largely avoided. Due to the mounting of the two gears 12 and 13, one of which carries the helical toothing 21, and of the distributor shaft 23 which carries the pinion 22, in the pump casing 8, the toothing arrangements can run at a small flank clearance since there are no radial assembly tolerances. This, in association with the damping properties of the oil cushion in the lubricating pump, counteracts the negative effects of crankshaft torsional vibration.

The constructional outlay involved by the distributor drive, in accordance with the invention, is relatively low and enables these assemblies to be arranged on the internal combustion engine in a manner which favors maintenance both of the lubricating pump and of the distributor.

If required, the distributor shaft 23 can carry an eccentric 29 through which a fuel pump 30 can be driven. In this way, a group of essential auxilliary drives for an internal combustion engine can be incorporated into a single unit.

What is claimed is:

1. An improved drive for the ignition distributor of an internal combustion engine of the type having a crankshaft and a lubrication pump driven by said crankshaft, said lubrication pump including a housing, an external gear having internal teeth and an internal gear having external teeth meshing, in planetary gear fashion, with the internal teeth of said external gear, said internal and external gears being located in said housing, said internal gear driving said external gear and being coaxial with, and rotatably driven by, said crankshaft, wherein the improvement comprises:

a distributor shaft rotatably journalled in said housing of said lubrication pump; and a pinion gear having helical teeth, said pinion gear being attached to said distributor shaft for causing rotation thereof, said external gear of said lubrication pump having external helical teeth meshing with said helical teeth of said pinion gear, said crankshaft when rotating driving said internal gear of said lubrication pump, said internal gear of said lubrication pump driving said external gear thereof, and said external gear driving said pinion gear and said distributor shaft.

2. An improved drive according to claim 1 wherein the transmission ratio from said internal gear to said external gear of said lubrication pump is 1 to 1.25 and wherein the transmission ratio from said external gear to said pinion gear is 1 to 1.6.

3. An improved drive according to claim 1 wherein said distributor shaft carries an eccentric suitable for operating a fuel pump for said engine.

4. An improved drive according to claim 2 wherein said distributor shaft carries an eccentric suitable for operating a fuel pump for said engine.

* * * * *